US008798874B2

(12) United States Patent
Taylor

(10) Patent No.: US 8,798,874 B2
(45) Date of Patent: Aug. 5, 2014

(54) SYSTEM FOR LIMITING CONTACT BETWEEN A DIPPER AND A SHOVEL BOOM

(75) Inventor: Wesley P. Taylor, Glendale, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 930 days.

(21) Appl. No.: 12/908,638

(22) Filed: Oct. 20, 2010

(65) Prior Publication Data

US 2012/0101693 A1 Apr. 26, 2012

(51) Int. Cl.
*E02F 9/20* (2006.01)

(52) U.S. Cl.
CPC ..... *E02F 9/2033* (2013.01)
USPC ..... 701/50; 37/396

(58) Field of Classification Search
CPC ..... E02F 9/2033; E02F 9/2037
USPC ..... 701/50; 37/396
See application file for complete search history.

(56) References Cited

U.S. PATENT DOCUMENTS

| | | | | |
|---|---|---|---|---|
| 3,207,339 | A * | 9/1965 | Neslin | 414/690 |
| 3,934,126 | A * | 1/1976 | Zalesov et al. | 701/50 |
| 4,368,521 | A * | 1/1983 | Sholes, II | 701/50 |
| 4,370,713 | A * | 1/1983 | McCoy et al. | 701/50 |
| 5,027,049 | A * | 6/1991 | Pratt et al. | 318/807 |
| 5,408,767 | A * | 4/1995 | Hazama et al. | 37/396 |
| 6,480,773 | B1 * | 11/2002 | Hilgart | 701/50 |
| 7,734,397 | B2 * | 6/2010 | Peterson et al. | 701/50 |
| 8,346,512 | B2 * | 1/2013 | McAree | 703/1 |
| 8,515,708 | B2 * | 8/2013 | McAree et al. | 702/150 |
| 2010/0283675 | A1 * | 11/2010 | McAree et al. | 342/357.28 |

FOREIGN PATENT DOCUMENTS

| | | | | |
|---|---|---|---|---|
| SU | 1416624 | * | 8/1988 | E02F 9/20 |

OTHER PUBLICATIONS

Internet article, "Gold Mining Equipment—Futuristic Shovel" (describing e.g., the P&H 4100XPB), Jul. 19, 2000, 2 pages, downloaded from http://www.miningsurplus.com/articles/3.*

Excerpt from CRC Standard Math Tables and Formulae, Section 4.7.2: Conics—The General Quadratic Equation, Copyright 1996 CRC Press LLC, 5 pages total (including title pages).*

P&H, P&H Update on C-Series Shovels and Centurion Technology, WMEA Tucson 2007, (20 pages).

P&H, Centurion Shovel Control System, Driving the Ultimate Digging Machine, 2009, (6 pages).

* cited by examiner

*Primary Examiner* — Behrang Badii
*Assistant Examiner* — David Testardi
(74) *Attorney, Agent, or Firm* — Michael Best & Friedrich LLP

(57) ABSTRACT

A system for limiting contact between a dipper and dipper attachments and a boom and machinery desk of a shovel, the system defining dipper to boom relative position in terms of crowd amount or hoist length, the system defining the relative position boom limits in terms of a second order polynomial of crowd amount or hoist length. The system also includes a slow speed region of the crowd amount and the hoist length, where the speed is varied depending on the crowd amount or the hoist length. The system also includes a field-strengthening region, depending on the crowd amount or the hoist length, where the field weakening is removed.

13 Claims, 8 Drawing Sheets

SYSTEM FOR LIMITING CONTACT BETWEEN A DIPPER AND A SHOVEL BOOM

BACKGROUND

This disclosure relates to electric rope shovels, and, more particularly, to ways to prevent the electric rope shovel dipper and attachments on the end of the shovel handle from contacting the remainder of the shovel.

FIG. 1 is an illustration of an electric rope shovel. The shovel 8 includes a dipper 22 for gathering material from a bank (not shown) and then moving the material to either a material pile (not shown) or a truck (not shown) for removing the material from the work site.

The power shovel 8 includes a platform in the form of a machinery deck 13, and an upwardly extending boom 15 connected at the lower end 16 to the platform 13, and a sheave 17 at the top of the boom 15. The dipper 22 is suspended from the boom 15 by a hoist rope 23 trained over the sheave 17 and attached to the dipper 22 at a bail pin 30. The machine structure is movable to locate the dipper 22 in respective loaded and unloading positions. More particularly, the structure is mounted on a turntable 12.

The power shovel 8 comprises a mobile base 10 supported on drive tracks 11, and having supported thereon through the turntable 12, the machinery deck 13. The turntable 12 permits full 360° rotation of the machinery deck 13 relative to the base.

The boom 15 is pivotally connected at 16 to the machinery deck 13. The boom 15 is held in a upwardly and outwardly extending relation to the deck 13 by a brace in the form of tension cables 18 which are anchored to a back stay 19 of a stay structure 20 rigidly mounted on the machinery deck 13.

The dipper 22 is suspended by the hoist rope or cable 23 from the sheave 17, the hoist rope 23 being anchored to a winch drum 24 mounted on the machinery deck 13. As the winch drum 24 rotates, the hoist rope 23 is either paid out or pulled in, lowering or raising the dipper 22. The dipper 22 has a handle 25 rigidly attached thereto, with the dipper handle 25 slidably supported in a saddle block 26, which is pivotally mounted on the boom 15 at 27. The dipper handle 25 has a rack tooth formation thereon (not shown) which engages a drive pinion (not shown) mounted in the saddle block 26. The drive pinion is driven by an electric motor and transmission unit 28 to effect extension or retraction of the dipper handle 25 relative to the saddle block 26.

A source of electrical power (not shown) is mounted on the machinery deck 13 to provide power to one or more hoist electric motors (not shown) that drives the winch drum 24, a crowd electric motor (not shown) that drives the saddle block transmission unit 28, and a swing electric motor (not shown) that turns the machinery deck turntable 12. The above described basic construction of the shovel loader is widely known and used and further details of the construction are not provided as they are well known in the art.

Each of the crowd, hoist, and swing motors is driven by its own motor controller (not shown) which responds to operator commands to generate the required voltages and currents in well known fashion. Interposed between the operator commands and the motor controllers is a programmable logic controller (PLC). The PLC includes a program that, in response to different conditions, causes the motor controllers to behave in a predetermined manner, as described below.

When the dipper moves relative to the boom, it is possible for the dipper to come into contact with the boom. In order to prevent this, the control system used to control the motors that move the handle in and out, and the hoist rope up and down, are monitored. The rotation of the crowd (handle) and hoist (rope) motors are counted, and based on these counts, assumptions are made regarding whether or not the crowd or handle position will cause the dipper to contact the boom, or whether the length of the hoist rope will cause the dipper to contact the boom. Based on these counts, boom limits in the motor control help prevent the dipper and attachments from contacting the boom or machinery deck.

The purpose of the boom limits thus is to prevent collisions between the attachment and the boom of a shovel. More particularly, the purpose of the boom limit system is to prevent the shovel attachment (handle, dipper, and bail) from making contact with the boom, as well as the over-run of the handle, and excessive rope pay out. The large mass and amount of force that can be generated by the attachment, impacting the boom can cause stress fractures and rapidly reduce the lifespan of the shovel frontend equipment. Due to the large mass and fast motion of the attachment the drives may require some time to slow down and then stop any motion that is destined for a collision.

FIGS. 2, 3, and 4 illustrate some of the possible different positions in which contact between the dipper or attachments and the boom or machinery deck can occur. More particularly, FIG. 2 shows the handle pulled back towards the housing, with the dipper contacting the boom. FIG. 3 shows the dipper lower, with the handle pulled back. FIG. 4 shows the dipper in the tuck position, with the dipper contacting the machinery deck and the boom.

Boom limit systems currently utilize a passive control design to prevent damage to the shovel. The boom limit system establishes a "slow down" and "zero speed" region based on offsets from a physical boom profile. As the operator enters a region, specific limitations are applied to the operator's references to prevent a potential impact.

Currently, there are two basic approaches to determining if there is a potential for contact between the dipper and the boom. One approach uses a substantial amount of information about all of the various components, to attempt to calculate a very exact dipper position. If an exact dipper position is known, then the dipper's position relative to the boom and machinery deck is also known. Although effective, the number of calculations required results in a serious amount of computational power being needed. Further, this adds a delay time to the control of the motors. Since the motor control needs to react to the potential of the dipper contacting the boom, slower motor change calculations result in the need to increase the dipper slow down region in order to stop potential boom contact. The other approach, at the other extreme, has been to use a fairly simple linear relationship between the crowd count and the hoist count, in order to determine when the dipper is nearing contact with the boom. Although effective, the linear approach results in the need for the region where impact might be possible to be much larger than it might be otherwise. This results in dipper slowdown at times when it is not necessary. This results in it taking longer for the shovel to complete its dig and dump cycle. This results in a crucial slowdown of dipper operation by the operator.

SUMMARY

An object of this disclosure is to improve upon the prior art linear approach misses an opportunity to operate the shovel without the need to control the motors at times to prevent dipper to boom contact. The area of missed opportunity is illustrated in FIG. 7. As a result, shovel operation is adversely affected while at the same time, not adding undo complexity to the motor control system.

This disclosure is thus directed to a new boom limit system for limiting contact between a dipper and dipper attachments and a boom and machinery desk of a shovel, the system defining dipper to boom relative position in terms of crowd amount or hoist length, the system defining the relative position boom limits in terms of a second order polynomial of crowd amount or hoist length.

The system also includes a slow speed region of the crowd amount and the hoist length, where the speed is varied depending on the crowd amount or the hoist length.

The system also includes a field-strengthening region, depending on the crowd amount or the hoist length, where the field weakening is removed.

The new boom limit system eliminates the following problems identified with the conventional approaches.

Inaccurate Boom Profiling

Restrictive Speed Reference Limit

Increased Crowd Motor RMS (Root Mean Square) Loading

Calibration Sensitivity to Operators

The new boom limit system has the potential to reduce calibration time, improve crowd motor reliability, reduce any adverse effects on cycle time, and other performance increases.

All boom limit systems are designed so that when a limit is entered, the motor speed is reduced. The conventional boom limit systems reduces the commanded operator reference by 10%, which causes the motor control system to quickly decelerate the load to match the speed requested.

Figure 1:
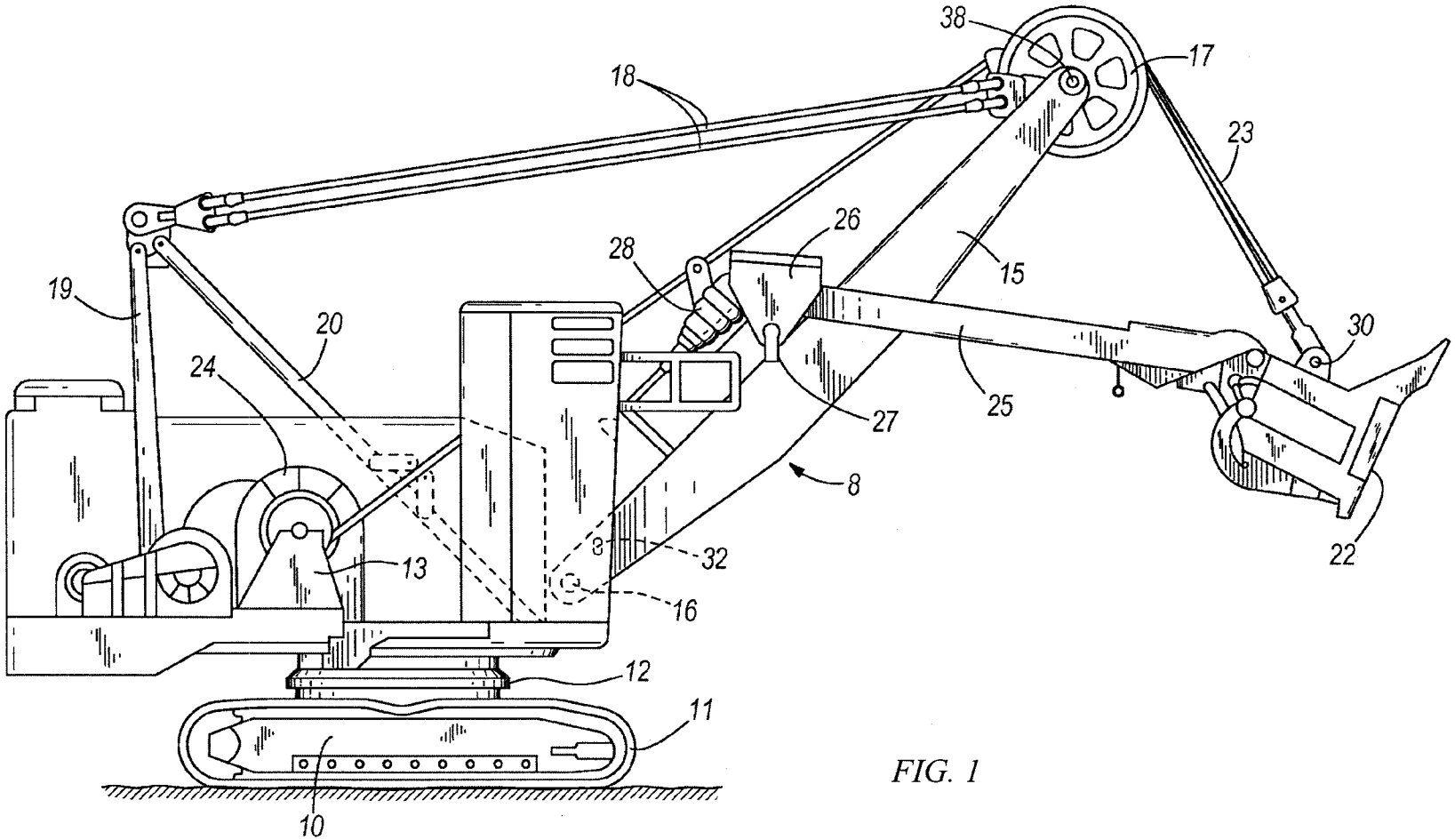
FIG. 1 is a side view of an electric rope shovel.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT

Figure 5:
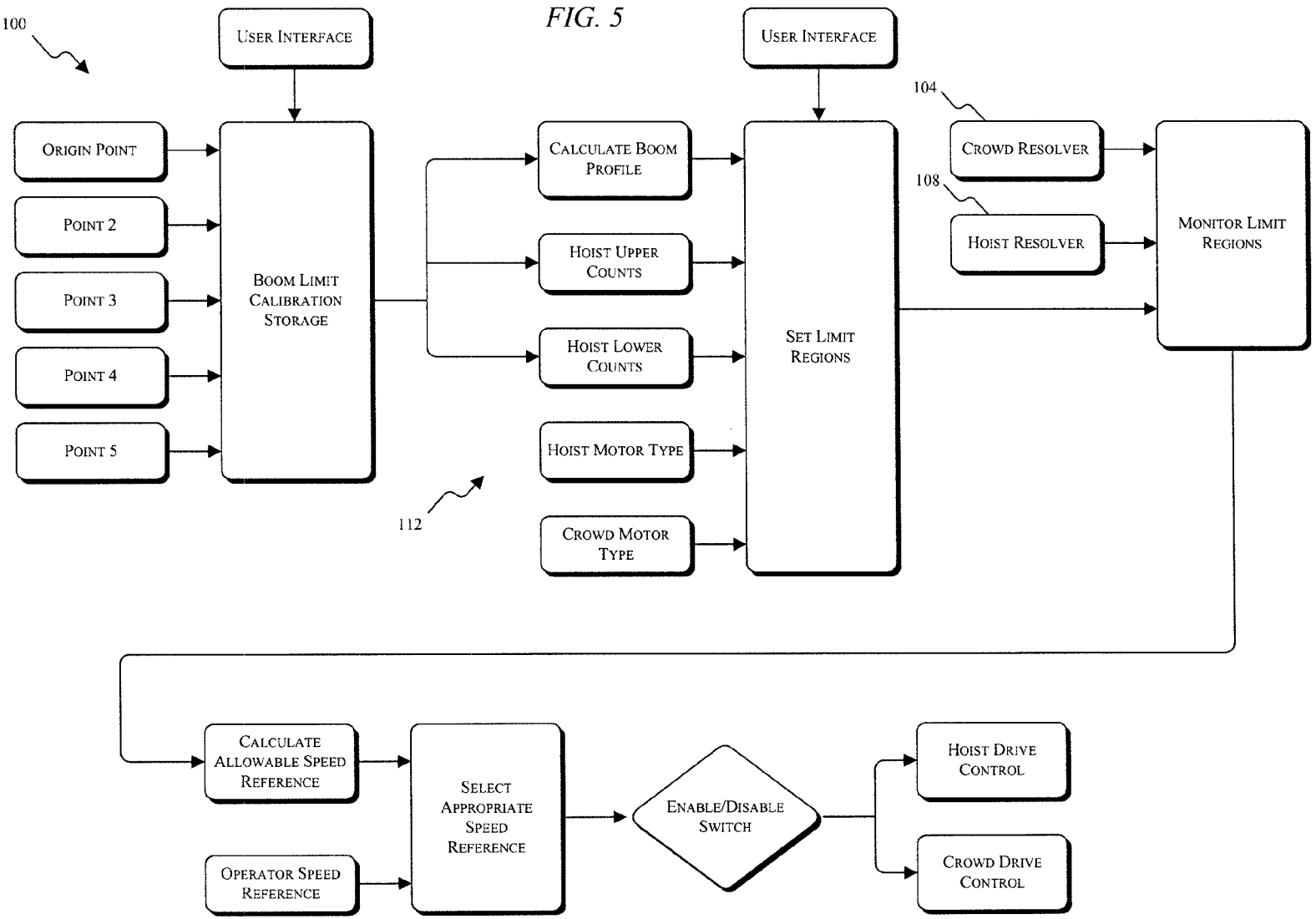
FIG. 5 is a schematic illustration of the boom limit control system of this disclosure.
Figure 6:
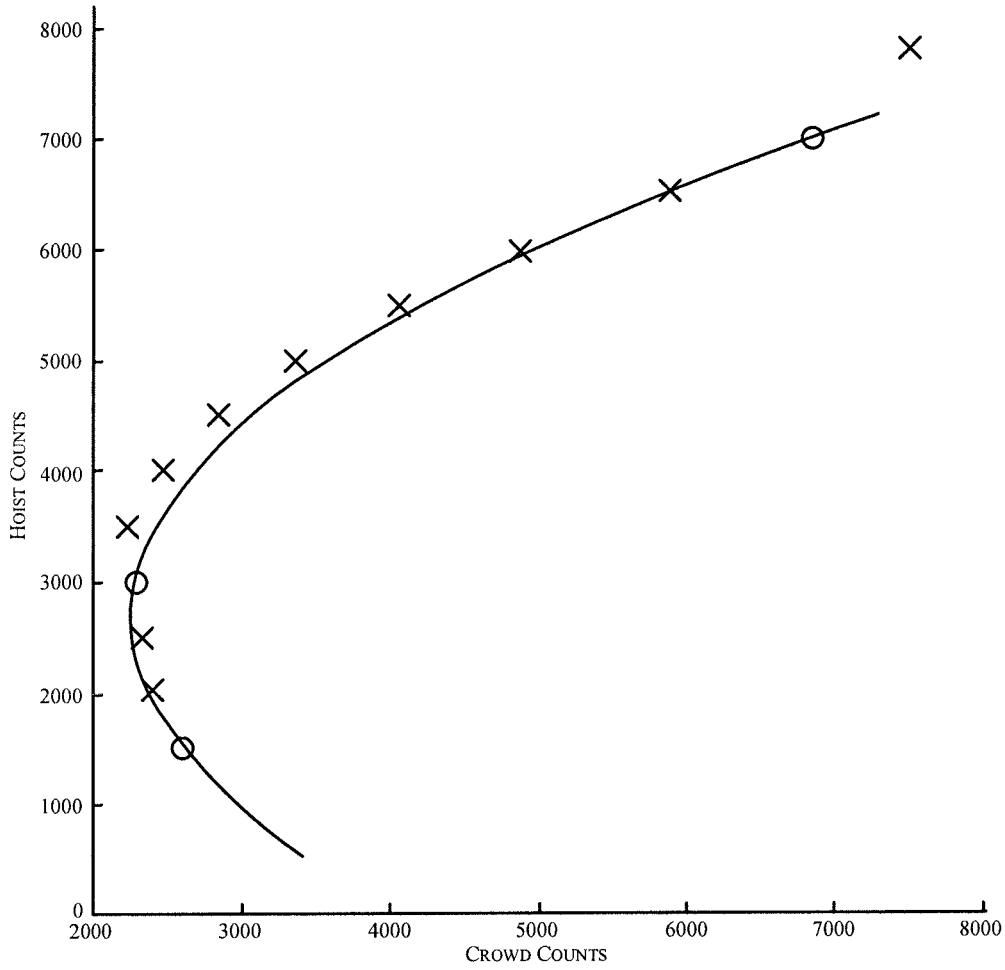
FIG. 6 is a graph illustrating the boom limits, as a function of crowd amount and hoist length, expressed in motor counts, as compared to the actual boom limits.
Figure 7:
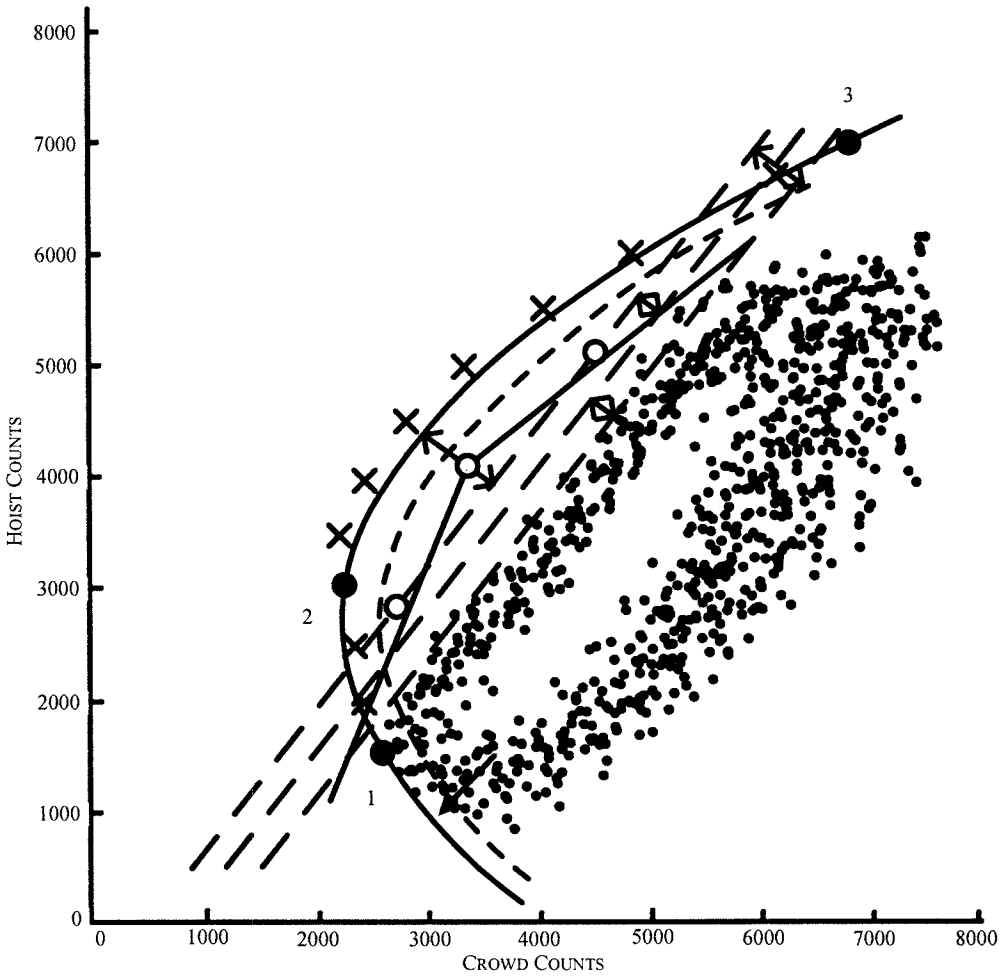
FIG. 7 is a graph similar to the graph in FIG. 6, only with the prior art straight approach compared to the boom limits of this disclosure. The points 1, 2, and 3 (circles) illustrated in FIG. 7 correspond to non-linear calibration points for a boom limit. The x's represent shovel data that was not used for calibration. The three oblique dashed straight lines represent the prior art straight calibration approach for a boom limit, a zero speed region, and a reduced speed region. An area of missed opportunity with respect to the prior art straight calibrations (i.e., where boom limit control was being applied unnecessarily) is illustrated approximately between an obtuse angled line and the straight calibration lines.
Figure 8:
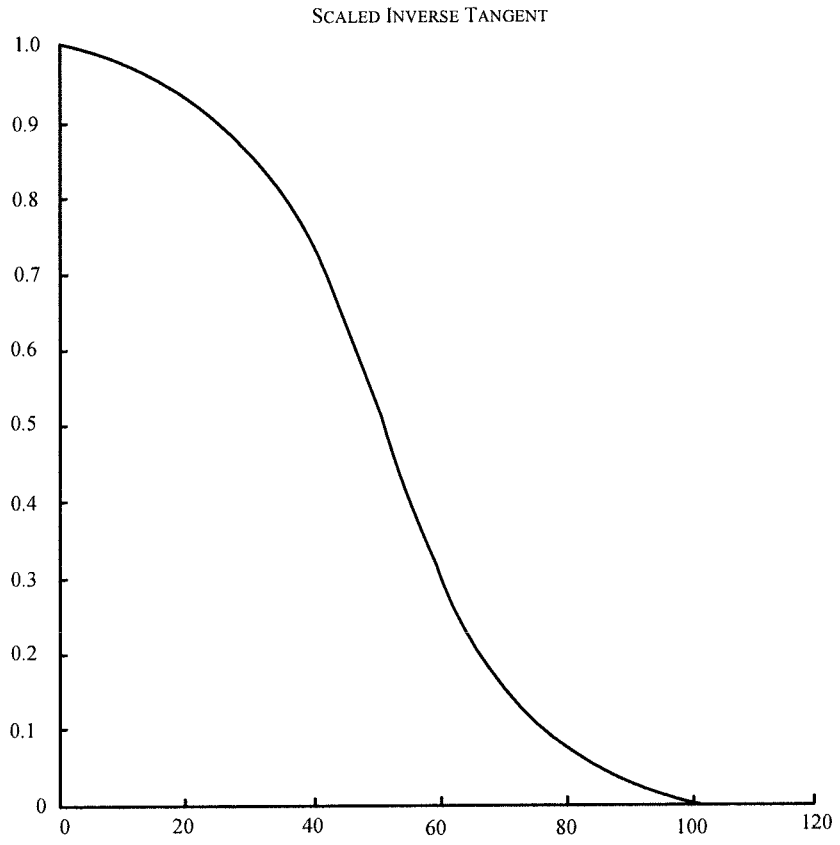
FIG. 8 is a graph of the s curve reduction in commanded motor parameters, resulting in a given dipper speed, showing the amount of reduction commanded, from left to right, as the crowd amount or hoist length are reduced.

The boom limit system 100 of this disclosure is illustrated in FIG. 5. More particularly, the boom limit system 100 includes means for measuring the crowd amount of movement of the shovel handle in the form of the crowd resolver 104, means for measuring the hoist length of the hoist rope in the form of the hoist resolver 108, and operating means for operating the crowd motor and the hoist motor, in the form of a motor controller 112.

The boom limit system also includes operating means including limiting means 116 for limiting crowd motor operation and hoist motor operation in response to the crowd amount and the hoist length, the limiting means operating in response to a result of at least a second order polynomial of the crowd amount and the hoist length.

More particularly, to properly monitor and control the shovel's motion the boom limit system needs to identify the relative position of the attachment. The way in which the boom limits are calculated begins with the establishing of a boom profile equation during calibration.

The boom profile limit is the closest the attachment can get to the boom. The boom profile equation is meant to equate the hoist resolver counts to a minimum crowd resolver count limit. As the shovel moves through a cycle, the boom limits continuously calculate the minimum crowd resolver count allowable for the given hoist resolver count. This establishes the zero point for the boom profile. From that zero point, the constraint equation of the motor speed reference is offset.

To accurately profile the boom, another calibration point was added to the current two points used to approximate the boom. The third point allows for generating a non-linear approximation of the entire boom profile without actually modeling the profile. The three points are uniquely placed to cause the non-linear approximation to fit the curvature of the boom.

Thus the boom profile, in addition to the two points at the extreme dipper limits, is made of three points that each represents a critical physical feature that makes up the boom profile's detail. The crowd and hoist resolver counts are recorded at each point during the calibration process. Once the three points are set, a second order polynomial fit is solved to approximate the relationship between the three points.

$$y_0=f(x_0)$$

$$y_1=f(x_1)$$

$$y_2=f(x_2)$$

The values for x are the hoist resolver counts, and the solution to the functions are the crowd resolver counts. The polynomial approximation for the system response is determined from those points by using the following form:

$$f(x)=b_0+b_1(x-x_0)+b_2(x-x_0)(x-x_1)$$

Coefficients b0, b1, and b2 are constant and dependant on the three points illustrated above. The coefficients are solved using the following forms:

$$b_0 = f(x_0)$$

$$b_1 = \frac{f(x_1) - f(x_0)}{x_1 - x_0}$$

$$b_2 = \frac{\left(\frac{f(x_2) - f(x_1)}{x_2 - x_1}\right) - \left(\frac{f(x_1) - f(x_0)}{x_1 - x_0}\right)}{x_2 - x_0}$$

The form of the non-linear approximation can be changed to represent the equation in the standard form of a 2nd order polynomial.

$$f(x)=ax^2+bx+c$$

Where the coefficients represent the following constants:

$$a=b_2$$

$$b=b_1-b_2(x_1+x_0)$$

$$c=b_0-b_1x_0+b_2x_0x_1$$

Changing the form of the non-linear approximation to the standard form of a 2nd order polynomial allows for the use of fewer constants when reconstructing the boom profile. Once the coefficients are found, the equation yields a non-linear approximation between the points used in the calibration. Since the points set are meant to be unique identifiers of the boom profile, the equation is used to approximate that boom profile.

The new boom limits thus require the following five-point calibration process. The five points (see FIG. 5) are used to establish the limit window in front of the shovel that restricts the position of the crowd and hoist motions. The following positions are example of such limits. The actual limits will depend on the size of the respective shovel.

Origin Point or Point 1—Hoist retraction limit and crowd extension limit.

Point 2—Hoist counts=7000 and crowd touching the boom.

Point 3—Hoist counts=3500 and crowd touching the boom.

Point 4—Hoist counts=2200 and crowd touching the boom.

Point 5—Dipper flat on the ground and the bail/equalizer horizontal.

The conventional boom limit system utilized only four points to calibrate, so while this disclosure increases the required number of calibration steps, the new boom limit system does not increase the overall time to complete the calibration, as shown by the following example. During the limit calibration, the speed of the shovel is limited to 10% to mitigate any risk of damage caused by an unrestricted impact. The calibrations for the old boom limit system and new boom limit system boom limits were followed exactly and the time to complete was recorded.

Performing the boom limits calibration on a P&H Mining Equipment 4100XPC DC shovel, the new boom limit system required only 8 minutes to calibration, as compared to the old boom limit system 12 minutes. The leading cause of the reduced time to calibration was achieved by removing unneeded motions, like lowering the dipper to the ground prior to retracting to set the third calibration point, and by increasing the repeatability of the procedure, so the operators are more familiar with the required motions.

The new boom limit system identifies when a limit is trigger and when the limit is exceeded. The old boom limit system would immediately reduce the speed reference when a limit is triggered, but the new boom limit system has the potential of not taking control unless the operator is commanding too high of a speed. When a limit is exceed both boom limit systems reduce the motor speed reference to zero. The previous profile of the boom caused difficulties retracting when exiting a truck and staying close enough to the boom while tucking. The new boom limit system's more advanced approximation of the boom removes the repeated entering and exiting of the retract limit during those conditions.

The boom limit system takes the most control of the shovel during the tuck phase. During this phase the operator typically commands full retract and full lower, and as the shovel moves into tuck, the motion is slowed down due to the proximity to the boom. The second phase that is effected by the boom limits is the swing to dump phase. During this phase, the operator is positioning the dipper near the extension limit to properly dump into a truck. The crowd motion is limited during both of these phases and is therefore a good performance indicator on the primary task of the boom limits.

The crowd extension limit (see FIG. 1) is set at the mechanical limit of the handle rack during the calibration of the origin point. The crowd resolver counts for this position are set during the origin point in the calibration process. While the motion of the shovel at crowd extension could cause complications as the handle pivots about the crowd pinion, a constant value is used to limit the crowd regardless of the hoist position.

Figure 2:
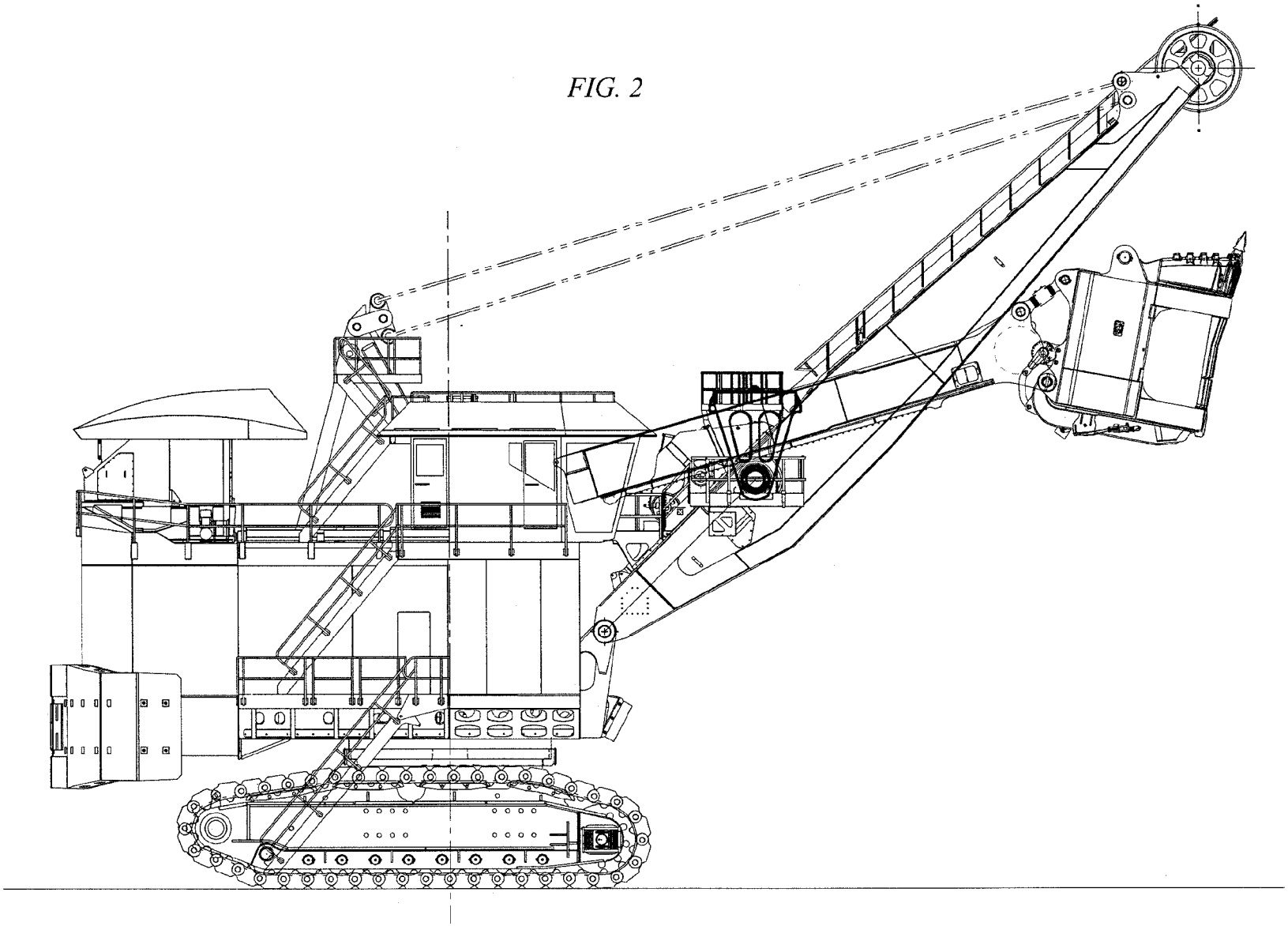
FIG. 2 shows a rope shovel according to FIG. 1, with the handle pulled back towards the housing, with the dipper contacting the boom.
Figure 3:
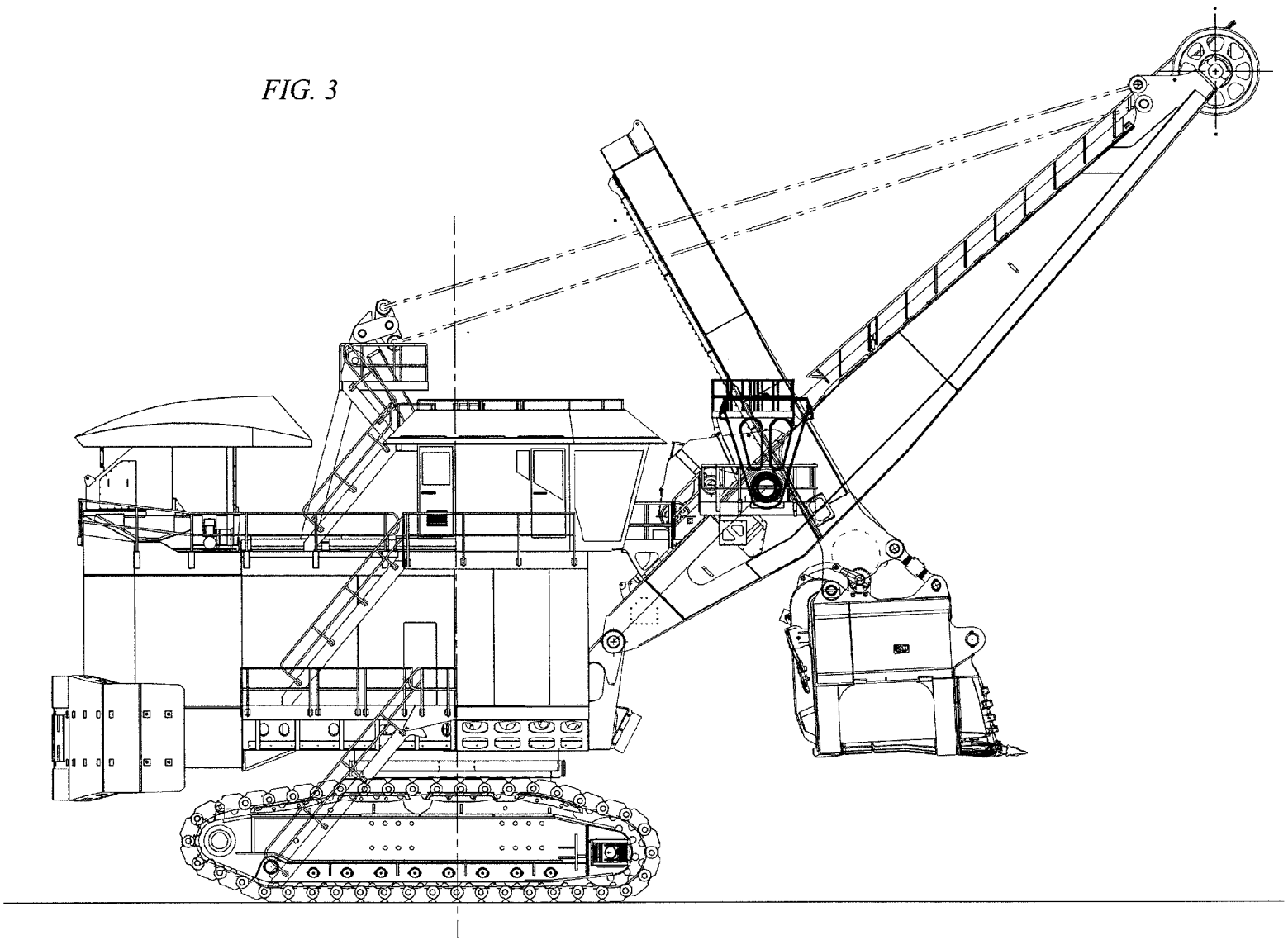
FIG. 3 shows a rope shovel according to FIG. 1, with the dipper lower, with the handle pulled back.

The hoist limit (see FIG. 2) is set during the calibration of the origin point. The hoisting limit stops the dipper from contacting the boom point sheaves. This limit is also assumed static regardless of the crowd position even though there is some amount of relationship.

Figure 4:
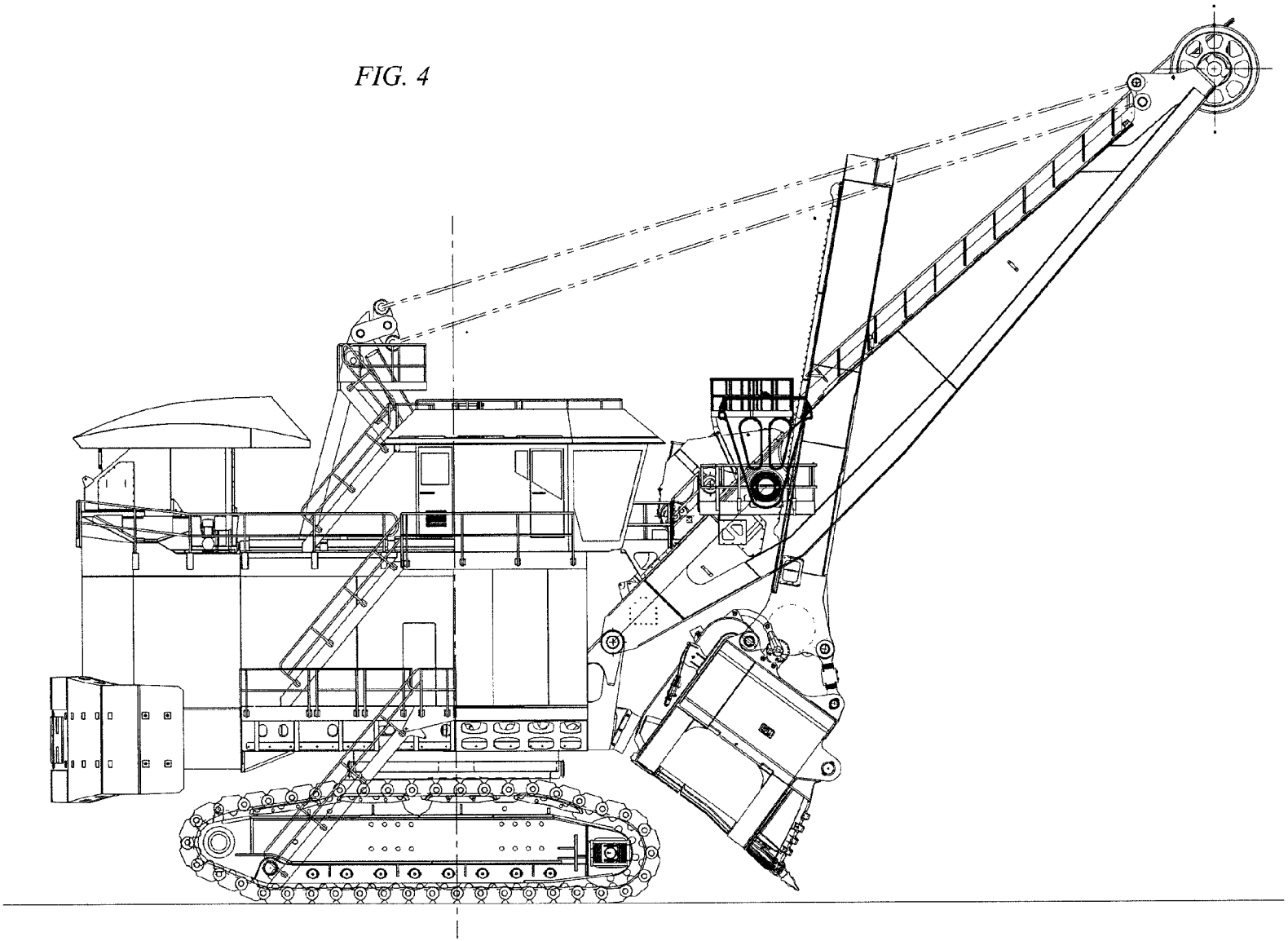
FIG. 4 shows a rope shovel according to FIG. 1, with the dipper in the tuck position, with the dipper contacting the machinery deck and the boom.

When the hoist ropes are approaching full extension the boom limits must prevent the drum from completely rolling out. A lowering limit (see FIG. 4) is implemented to prevent too much hoist rope.

Once the required limit points are identified the boom limits continuously check the current shovel position relative to each limit. Instead of using the raw hoist and crowd resolver counts, the counts are normalized to each limit profile, as follows.

$$\text{CountsToLimit}=\text{CurrentCounts}-\text{ZeroCounts}$$

The "zero counts" are calculated as the absolute resolver count limits for each limit profile. Since the boom profile limit is the most complicated limit, the following example illustrates how to normalize the resolver counts. Only the crowd counts are normalized to the boom profile limit.

$$\text{CountsToBoom}=\text{CurrentCounts}-\text{BoomZeroCounts}$$

The "BoomZeroCounts" is illustrated as the boom profile equation. For the other limits, a constant value is used.

$$\text{BoomZeroCounts}=b_0+b_1(\text{CurrentHoistCounts}-x_0)+\ldots b_2(\text{CurrentHoistCounts}-x_0)(\text{CurrentHoistCounts}-x_1)$$

The boom limits calculate the zero counts for each limit and determines distance between the current location and each limit.

The new boom limit system utilizes a variable speed reference controller that gradually changes the speed reference. The drive reacts less drastically to reduce the speed of the load and in turn reduces the amount electrical and thermal strain on the motor. The other benefit of the new boom limit system is by only changing the commanded speed reference if it is larger then the calculated speed reference maximum. More particularly, a variable speed reference controller was implemented in place of the static 10% speed reference limit from the previous boom limit system. The variable speed reference controller was designed to reduce the ability to overrun the boom limits, causing an impact, while allowing for increased speeded when passing through the limits.

The average retract speed on comparable tuck motions has almost doubled with the new boom limit system. Implementing the variable speed reference controller has reduced the speed reference to motor speed error, while in a limit, preventing the ability of having the limits be overrun during a dynamic tuck. The operators utilizing the new boom limit systems do not fight against the limits as much and rarely reverse reference when not needed.

The primary goals of the constraint equations are to reduce or zero the motor speed of the motion identified as potentially colliding with a limit. A secondary goal is to prevent harmful RMS loading caused by the slow down of the motor when in the reduced or zero speed zones. The constraint equation is universally applied to both the hoist and crowd motions in both the positive and negative directions. The constraint regions are identified in resolver counts and extend from the zero speed limits inward within the limit window. The maximum motor speed reference will be reduced based on the position within the slow-down region and the constraint equation applied.

In other words, the boom limits define the maximum amount in which the dipper might be brought back toward the boom and machinery deck. In order to allow time to slow down the dipper prior to any contact, the dipper movement needs to be slowed down prior to the time contact may occur. In order to do this, two regions or areas where the dipper nears the boom are defined. One is a region where no speed reference is applied by the motor control system. This is nearest to the actual boom limits where contact is estimated to occur. And the other region is a slow down region, which is found even further from the actual boom limits. In this region, the motor speed reference is reduced in order to begin to slow down the dipper. In one preferred embodiment of this invention, a third region is added. This a field-strengthening region, even further out from the actual boom limits, where field weakening, which reduces torque but increases speed, may have been applied. By removing the field weakening, more torque is now available in order to aid in the slowing down of the dipper movement. The actual limits of the various regions are somewhat arbitrary, and can be determined by the control system creator based on operator expectations and shovel characteristics.

The constraint equation limits the maximum speed reference the operator can command at the joysticks. Instead of scaling the operator's incoming reference, the system limits the reference based on the value calculated by the constraint equation. The control model is similar to a "governor" or "control-configured vehicle" (also called CCV) found in "fly-by-wire" controls. This control model allows the operator to command any reference but the control system limits or replaces that command due to machine limitations, operator-induced oscillations, or any command that may cause damage to the system.

By limiting the operator's commands instead of scaling them, the operator can become familiar with this control scheme being applied on the shovel. If the control system simply scales the operator's commands, it will be difficult for the operator to know exactly what command he is attempting to apply when he reduces or increases the joystick reference. Instead, the control system will have the final say on the commands before applying them to the drives on the shovel.

The constraint equation establishes the maximum allowable reference. The two main ideas for the constraint equation are to use either a linear ramp, or an s-curve.

A linear ramp constraint equation uses a slow down region and a zero speed region to stop the motor.

The linear ramp constraint is applied in the slow down region. The equation for a simple ramp is shown.

$$f(x)=K_{ramp}x$$

As the motor enters the slowdown region, the maximum allowable speed reference needs to decrease from 100% downward.

$$f_{spdref}(x)=100-K_{ramp}x$$

The value for x is the distance in counts the motor has entered the slowdown region, the constant K is related to the size of the slow down region, and the output of the function is the maximum allowable speed reference.

The ramp decreases the speed reference down to 10% then stays constant until the zero speed region is entered. A 10% speed reference is assumed to prevent any harmful affects of controlling a motor near zero speed.

$$If\ f_{spdref}(x)<10 \text{ then } f_{spdref}(x)=10$$

A secondary benefit of utilizing a 10% speed reference limit on the ramp constraint is it allows the drive and motor time to match the requested speed reference. Any error between the requested speed reference at the actual speed of the motor would roll over into the zero speed region.

The zero speed region applies a constant zero speed reference to the motor. The zero speed region is located directly next to the limit.

$$f_{spdref}(x)=0$$

The zero speed region does not depend on distance entered into the region.

The following illustrates the pros and cons of implementing the linear ramp constraint.

+Simple constraint equation to implement.

+Reduced error between the requested speed reference and the drive speed reference since the constraint equation would be similar to the ramp rate of the drive.

−Error between requested speed reference and the drive speed reference is applied at the end of the constraint equation right before the zero speed region. Potentially requiring a larger slow down region (specifically the 10% band) or a larger zero speed region to prevent impacts.

The s-curve constraint utilizes three regions: field strengthening (removing of field weakening), slow down, and zero speed.

The first limit region entered is the Field Strengthening region. This region only applies to drives that are set for field weakening (DC and AC). When an operator enters this region the maximum allowable speed is a percentage of the base speed of the motor. The goal is to reduce the reference enough that the drive comes out of field weakening and begins decelerating the motor.

$$f_{spdref}(x)=K_{FSref}$$

The region size is set to allow the drive enough time to slow down to base speed where maximum torque is available before entering the slow down region. If the drive is not set for field weakening the Boom Limits will not do anything to the speed reference until the operator enters the slow down region.

The goal is to have a minimal impact to the speed reference as it enters the slow down region in case the operator is just moving through but not directly toward the boom. If the operator continues to move toward the boom the speed reference drastically reduces until it is almost minimal before entering the zero speed region.

As the shovel moves into the slow down region the maximum allowable speed reference is constrained by an s-curve. Inverse tangent performs a s-curve that is utilized in the constraint.

$$f(x)=\tan^{-1}(x)$$

The range of values (±x) used in the inverse tangent are dependant on the desired response at the beginning, middle, and end of the slow down region.

Once the desired range of values is selected the inverse tangent plot is then shifted and scaled so the output range is 1 to 0.

Once the s-curve is scaled and shifted to represent a 1 to 0 output the constraint equation can be illustrated in the form:

$$f_{spdref}(x) = K_{FSref}\left(\frac{\tan^{-1}(K_s x)}{2*\tan^{-1}(Range_{min})} + 0.5\right)$$

The x variable has a specified range for the region, and the inverse tangent curve used has its own specified range for reproducing an ideal s-curve. Ks is used to scale the incoming x from its current range to the range used by the inverse tangent curve. The value is then divided by a constant to scale the output between 0.5 and −0.5, and finally the s-curve is shifted up so the output is always positive. If field strengthening is required before entering the slowdown region, the s-curve is multiplied by the field strengthening gain.

The s-curve decreases the speed reference down to 10% then stays constant until the zero speed region is entered. A 10% speed reference is assumed to prevent any harmful affects of controlling a motor near zero speed.

$$If\ f_{spdref}(x)<10\ \text{then}\ f_{spdref}(x)=10$$

The secondary benefit of limit down to 10% speed reference is allowing the motor to catch up with the speed reference commanded by the slow down region.

When the shovel moves through the slow down region and enters the zero speed region the speed reference is zeroed and the drive will stop the motion. The operator will no longer be able to move toward the boom or object projected. If the operator reverses direction the Boom Limits will not effect the speed reference only if the operator continues motion toward the boom.

$$f_{spdref}(x)=0$$

The following illustrates the pros and cons of implementing the s-curve constraint.

+Error between the requested speed reference and the drive speed reference is minimal during the slow down region before the zero speed region.

+Field strengthening region requires the drive to reapply maximum torque to slow down a potential large unknown load.

−More complicated constraint equation to implement.

As the drive tries to accelerate and decelerate the motor the amount of energy applied can vary dramatically based on the load and the requested speed. This causes the RMS loading of the motors to increase. To prevent undue stress and decreased reliability of the motors, the constraint equations applied to the Boom Limits must have a minimal impact while conforming to the safety requirements.

Various other features of this disclosure are set forth in the following claims.

The invention claimed is:

1. A system for limiting contact between an attachment and a boom of an industrial machine, the system comprising:

a first resolver for determining a first position of a first component of the industrial machine, the first resolver having a first resolver count;

a second resolver for determining a second position of a second component of the industrial machine, the second resolver having a second resolver count; and a controller configured to determine a minimum resolver count for the first resolver based on the second resolver count and a non-linear approximation of a boom profile, and limit operation of a first motor associated with the first resolver or a second motor associated with the second resolver based on the first resolver count, the second resolver count, and the minimum resolver count, wherein limiting operation of the first motor or the second motor includes the controller entering a field strengthening mode of operation, a reduced speed mode of operation, and a zero speed mode of operation based on the first resolver count, the second resolver count, and the minimum resolver count.

2. The system of claim 1, wherein the non-linear approximation includes at least a second-order polynomial function associated with the boom profile.

3. The system of claim 1, wherein a speed of the first motor is reduced based on the first resolver count, the second resolver count, and the minimum resolver count.

4. The system of claim 1, wherein the first component of the industrial machine is a dipper handle and the second component of the industrial machine is a hoist rope.

5. The system of claim 1, wherein the attachment is a dipper.

6. The system of claim 1, wherein the controller is further configured to calibrate the non-linear approximation of the boom profile.

7. The system of claim 1, wherein the controller is further configured to calculate a maximum reference speed for the first motor based on the first resolver count and the second resolver count.

8. The system of claim 7, wherein limiting the operation of the first motor or the second motor includes reducing the speed of the first motor or the second motor when the first resolver count corresponds to the minimum resolver count and a commanded speed exceeds the maximum reference speed.

9. A method of limiting contact between an attachment and a boom of an industrial machine, the method comprising:

calibrating a non-linear approximation of a boom profile;

determining a first position of a first component of the industrial machine based on a first resolver count of a first resolver;

determining a second position of a second component of the industrial machine based on a second resolver count of a second resolver;

determining a minimum resolver count for the first resolver based on the second resolver count and the calibrated non-linear approximation of the boom profile;

applying field strengthening to the first motor associated with the first resolver or the second motor associated with the second resolver during a field strengthening mode of operation based on the first resolver count, the second resolver count, and the minimum resolver count;

reducing a speed of a first motor associated with the first resolver or a second motor associated with the second resolver during a reduced speed mode of operation based on the first resolver count, the second resolver count, and the minimum resolver count; and stopping the first motor associated with the first resolver or the second motor associated with the second resolver during a zero speed mode of operation based on the first resolver count, the second resolver count, and the minimum resolver count.

10. The method of claim 9, wherein the non-linear approximation includes at least a second-order polynomial function associated with the boom profile.

11. The method of claim 9, wherein the first component of the industrial machine is a dipper handle, the second component of the industrial machine is a hoist rope, and the attachment is a dipper.

12. The method of claim 9, further comprising calculating a maximum reference speed for the first motor based on the first resolver count and the second resolver count.

13. The method of claim 12, wherein the speed of the first motor or the second motor is reduced when the first resolver count corresponds to the minimum resolver count and a commanded speed exceeds the maximum reference speed.

* * * * *